US005813265A

United States Patent [19]

Shaw et al.

[11] Patent Number: 5,813,265

[45] Date of Patent: Sep. 29, 1998

[54] BALANCED ELECTROMAGNETIC PEENING

[75] Inventors: James S. Shaw, Hampton Falls, N.H.; Neil A. Johnson, Schenectady, N.Y.

[73] Assignee: General Electric Company, Cincinnati, Ohio

[21] Appl. No.: 989,243

[22] Filed: Dec. 12, 1997

[51] Int. Cl.[6] ..... B21D 26/14

[52] U.S. Cl. ..... 72/56; 72/53; 72/707

[58] Field of Search ..... 72/53, 54, 56, 72/430, 707

[56] References Cited

U.S. PATENT DOCUMENTS

| | | | |
|---|---|---|---|
| 3,088,200 | 5/1963 | Birdsall et al. . | |
| 3,372,566 | 3/1968 | Schenk et al. | 72/56 |
| 3,650,846 | 3/1972 | Holland et al. | 148/4 |
| 3,703,958 | 11/1972 | Kolm | 72/56 |
| 3,704,506 | 12/1972 | Orr et al. | 72/56 |
| 4,143,532 | 3/1979 | Khimenko et al. | 72/56 |
| 4,170,887 | 10/1979 | Baranov | 72/56 |
| 4,401,477 | 8/1983 | Clauer et al. | 148/4 |
| 4,641,510 | 2/1987 | Mitsching et al. | 72/53 |
| 4,937,421 | 6/1990 | Ortiz, Jr. et al. | 219/121 |
| 5,046,345 | 9/1991 | Zieve | 72/707 |
| 5,525,429 | 6/1996 | Mannava et al. | 428/610 |
| 5,569,018 | 10/1996 | Mannava et al. | 415/200 |
| 5,591,009 | 1/1997 | Mannava et al. | 416/241 R |

FOREIGN PATENT DOCUMENTS

2947144A1 6/1980 Germany .

*Primary Examiner*—David Jones
*Attorney, Agent, or Firm*—Andrew C. Hess; Nathan D. Herkamp

[57] ABSTRACT

An electromagnetic peening apparatus includes a first electromagnetic coil having a first face configured to conform to a first surface of a workpiece, and a second electromagnetic coil having a second face configured to conform to a second surface of the workpiece. A carriage positions the first and second coils in abutting contact with the workpiece at respective first and second faces and surfaces. A power supply powers the coils to produce electromagnetic force therein to plastically deform the workpiece at the first and second surfaces to effect a compressive layer therein.

10 Claims, 3 Drawing Sheets

BALANCED ELECTROMAGNETIC PEENING

BACKGROUND OF THE INVENTION

The present invention relates generally to metal cold working, and, more specifically, to surface peening for forming a residual compressive layer.

In components subject to high stress during operation, such as gas turbine engine rotor disks or rotor blades for example, it is common to treat the surface of the component to produce residual compressive stresses therein during manufacture. Residual compressive stress in a surface of these components correspondingly reduces the tensile surface stress when the components are rotated during operation. The compressive layer also suppresses crack growth due to surface and sub-surface inclusions. Accordingly, a substantial improvement in high cycle fatigue (HCF) life is obtained.

Furthermore, a turbine component, like the rotor disk, is typically machined from a forging within small manufacturing tolerances measured in mils. The machining process may impart residual tensile stresses in the surface of the components which may be relieved or compensated by treating the surface to effect a compressive layer therein.

Surface treatment is typically provided by conventional shot peening. In shot peening, metal or glass shot is bombarded against the surface of the component with suitable intensity and overlapping coverage to plastically deform the surface and effect a residual compressive layer therein. The amount of compressive stress imparted in the component is based on the intensity or momentum of the impacting shots, as well as the repetition rate or surface coverage thereof.

Recent data substantiates that peening with shot to a high intensity or high coverage may cause surface damage which deteriorates the life of the components. Such life deterioration is believed to be caused by excessive or severe cold working of the surface material.

One solution to this problem is the reduction in intensity and coverage of the peening process but this can result in reduced part life. Another solution is the replacement of conventional steel shot with specially conditioned cut wire shot of larger diameter which increases manufacturing cost due to the additional processing time required.

Since conventional shot peening necessarily requires the continuous bombardment of the surface material with metal or glass shot, many variables in the process must be accurately controlled for in turn controlling the resulting compressive layer in an attempt to maximize the beneficial effects thereof without degrading the mechanical strength of the components.

The prior art also includes various electromagnetic apparatus for deforming metal components for various purposes including peening. However, no present electromagnetic apparatus is known for providing effective peening of precision machined gas turbine engine components with suitable compressive layers generated from electromagnetic forces. And, the use of electromagnetic force must be carefully controlled to avoid undesirable distortion of the components which would exceed their manufacturing tolerances rendering the components unusable. Since surface treatment is one of the last processes in fabricating a gas turbine engine component, damage of that component in surface treatment is to be carefully avoided in view of the relatively high manufacturing cost involved.

Accordingly, it is desired to provide an improved electromagnetic peening apparatus for precisely providing compressive surface layers in components without undesirable distortion thereof.

SUMMARY OF THE INVENTION

An electromagnetic peening apparatus includes a first electromagnetic coil having a first face configured to conform to a first surface of a workpiece, and a second electromagnetic coil having a second face configured to conform to a second surface of the workpiece. A carriage positions the first and second coils in abutting contact with the workpiece at respective first and second faces and surfaces. A power supply powers the coils to produce electromagnetic force therein to plastically deform the workpiece at the first and second surfaces to effect a compressive layer therein.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
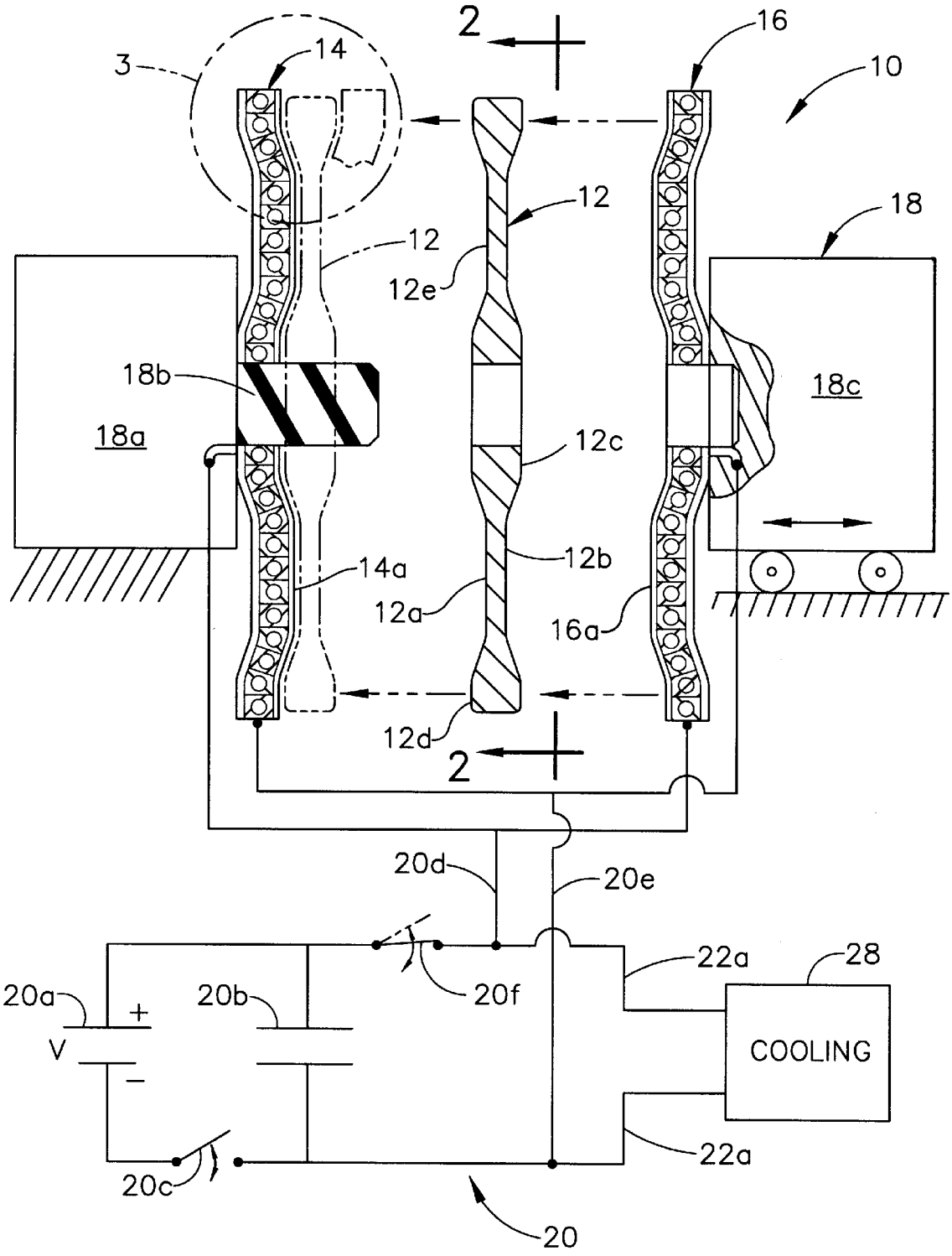
FIG. 1 is a schematic representation of an electromagnetic peening apparatus in accordance with an exemplary embodiment of the present invention configured to peen a gas turbine engine rotor disk.

Illustrated schematically in FIG. 1 is an exemplary apparatus 10 for electromagnetic peening a precision machined workpiece or component 12 in the exemplary form of a gas turbine engine rotor disk. The disk 12 is initially fabricated in any conventional manner such as machining forged metal to the desired configuration within suitably small manufacturing tolerances of several mils. As indicated above, it is desirable to impart a compressive surface layer over the disk 12 for improving its useful life during operation. Conventionally, this would be accomplished by using steel or glass shot peening in a process which controls the intensity and coverage of the peening shot for avoiding excess cold working of the surface material and degradation thereof.

In accordance with the present invention, a compressive surface layer may be effected on the disk 12 using electromagnetic force which may be accurately controlled for accurately controlling the formation of the compressive layer in an extremely fast, microsecond process. More specifically, the peening apparatus 10 illustrated in FIG. 1 includes a first electromagnetic coil 14 having a side or surface defining a first face 14*a* specifically configured to conform to or match the corresponding side or surface of the disk 12 defining a first surface 12*a*. Similarly, a second electromagnetic coil 16 has a side or a surface defining a second face 16*a* specifically configured to conform to or match an opposite corresponding side of the disk 12 defining a second surface 12*b*.

The individual coils 14,16 may take any suitable configuration in accordance with the present invention for matching the required surface contours on opposite sides of a workpiece such as the disk 12 illustrated for example.

As shown in FIG. 1, the exemplary disk 12 includes a radially inner hub 12*c*, a radially outer rim 12*d*, and an axially thinner web 12*e* extending therebetween in an integral one-piece component. The axially opposite sides of the disk 12 define the first and second surfaces 12*a,b* extending radially from the central aperture of the hub 12*c* to the outer perimeter of the rim 12*d* over which it is desired to impart a compressive surface layer by electromagnetic peening. The side surfaces 12*a,b* of the disk 12 may have any conventional profile which typically varies in axial thickness from the hub to the rim. Accordingly, the corresponding first and second coils 14,16 are specifically configured to provide mirror matches in profile to the respective disk first and second surfaces 12*a,b* for peening thereof.

The coils 14,16 may be mounted in any convenient manner on both sides of the disk 12 for effecting electromagnetic peening thereof. In the exemplary embodiment illustrated in FIG. 1, means in the form of a carriage 18 are provided for positioning the coils 14,16 in abutting contact with the disk 12 at the respective first and second faces 14*a*,16*a* and disk surfaces 12*a,b*. For example, the carriage 18 may include a stationary frame or base 18*a* having a spindle 18*b* extending therefrom which supports both the first coil 14 and the disk 12 through its bore. The spindle 18*b* may be formed of any suitable electrically insulating material.

The carriage 18 also includes a suitable truck 18*c* on which is mounted the second coil 16 which is translated into position opposite to the first coil 14, with the disk 12 being mounted therebetween in a clamped-together assembly. The carriage 18 therefore positions the first and second coils on opposite sides of the disk 12 to capture the disk 12 therebetween to prevent its movement during peening operation.

The peening apparatus 10 also includes suitable means in the form of a power supply 20 for electrically powering the first and second coils 14,16 to produce electromagnetic force therein to plastically deform the disk 12 at its first and second surfaces 12*a,b* and effect a residual compressive layer therein. This layer preferably extends only in small part into the disk 12 as in conventional shot peening, which may be up to about a few mils.

The power supply 20 may take any suitable form including a DC voltage source such as one or more batteries 20*a* for charging one or more capacitors 20*b*. A first switch 20*c* is joined in a suitable circuit with the battery and capacitor for charging the capacitor to a sufficient energy level. The capacitor is preferably oppositely joined to the first and second coils 14,16 with a pair of electrical leads 20*d,e* for effecting electrical circuits between the coils and the capacitor. A second switch 20*f* is operatively joined in the circuit for discharging the capacitor when desired for powering the coils to effect the electromagnetic peening process.

Although each of the coils 14,16 may be separately and independently powered with a dedicated power supply therefor, in the preferred embodiment illustrated in FIG. 1, the power supply 20 is operatively joined to both the first and second coils to produce the electromagnetic force substantially simultaneously. The coils 14,16 are therefore configured in opposite polarity for exerting force on both sides of the disk 12 simultaneously. This will reduce the possibility of undesirable movement or distortion of the disk 12 during the peening operation.

Since it is desirable to maximize the peened surface area of the disk 12 in one peening operation, the first and second coils 14,16 are preferably complementary with the first and second surfaces 12*a,b* of the disk 12, respectively, for simultaneously forming the compressive surface layers therein. The first and second coils are therefore configured with faces 14*a*,16*a* which are substantially mirror images of the corresponding disk surfaces 12*a,b* and are similarly disk shaped as shown in more detail in FIG. 2.

The first and second coils are preferably substantially identical in configuration with each including a unitary electrical conductor 22 suitably wound in a generally coplanar spiral having a plurality of laterally or radially adjacent sections collectively defining the respective first and second faces 14*a*,16*a*. The conductors 22 may be formed of copper, for example, and individually coated with a suitable electrical insulator for preventing short circuits between the abutting or overlapping sections thereof in the resulting spiral.

Respective opposite ends of each conductor 22 are correspondingly joined to the power supply leads 20*d,e* for carrying current therethrough. The two coils 14,16 may be identically wound and oppositely joined to the electrical leads 20*d,e* in opposite polarity. Or, the two coils 14,16 may be oppositely wound and connected to the leads 20*d,e* in the same polarity so that the electromagnetic forces generated in each of the coils is axially directed into the respective disk surfaces 12*a,b* in opposite directions toward each other.

Furthermore, the power supply 20 is configured in conjunction with the coils 14,16 to produce substantially equal and opposite electromagnetic forces from both of the coils 14,16 which compress therebetween the disk 12 during the peening operation. The reaction forces are suitably carried by the carriage base 18*a* and truck 18*c* which is suitably locked into position during the peening process.

Figure 3:
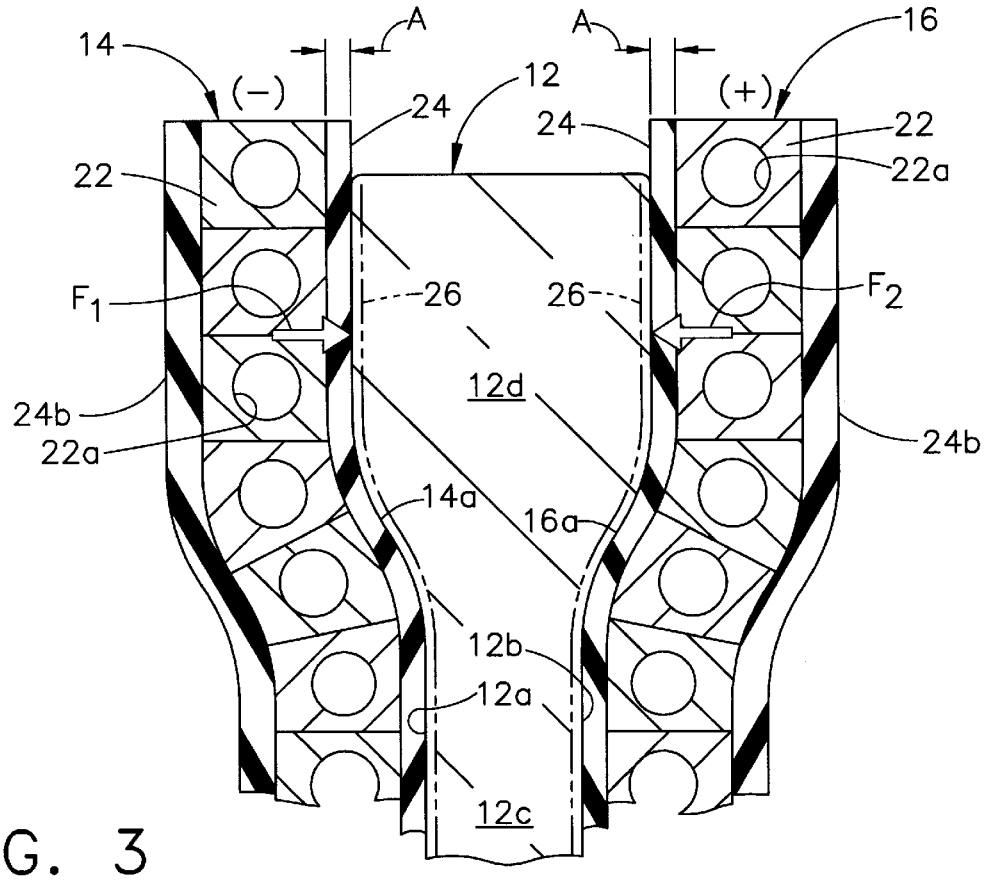
FIG. 3 is an elevational sectional view through a radially outer portion of the disk and adjoining first and second electromagnetic coils of the apparatus illustrated in FIG. 1 within the dashed circle labeled 3.

FIG. 3 is an enlarged sectional view of the radially outer portion of the disk 12 and the abutting coils 14,16 during the peening operation. The generated electromagnetic forces are designated $F_1$ for the first coil 14 and $F_2$ for the second coil 16 and are generated along the entire coil faces 14*a*,16*a* although single arrowheads are illustrated for clarity.

Since the exemplary workpiece is in the form of the disk 12, the conductors 22 of the first and second coils preferably spiral radially to form substantially coplanar disk coils which are complementary to the respective disk surfaces 12*a,b*. Each of the coils 14,16 preferably also includes an electrically insulating face sheet 24 suitably attached or bonded atop the respective first and second faces 14*a*,16*a* for matching the contours thereof as well as matching the respective contours of the disk first and second surfaces 12*a,b*.

The face sheets 24 preferably have identical thicknesses A for maintaining a predetermined spacing, also A, between the electrical conductors 22 and the disk surfaces 12*a,b* when the face sheets 24 abut the disk 12 on its opposite sides during the peening process. The face sheets 24 maintain the predetermined spacing for maximizing the electromagnetic force imparted into the disk from its opposite sides, and also provide a wear surface which may be replaced as desired after extended use. The face sheets 24 also maintain electrical insulation over the electrically conducting disk 12 through which magnetic flux is carried during the peening process. Each of the coils 14,16 may also include a suitable back sheet or backer 24*b* formed of an electrically insulating material to provide a rigid back support for the individual coils.

In operation, the disk 12 is mounted in the carriage 18 and sandwiched between the first and second coils 14,16 which are brought together in abutting contact therewith, with the truck 18*c* being locked in position. As shown in FIG. 3, the coils 14,16 are suitably energized by the power supply 20 for producing the first electromagnetic force $F_1$ on the disk first surface 12*a,* and producing the second electromagnetic force $F_2$ on the opposite second surface 12*b* of the disk substantially simultaneously with the first force to plastically deform the disk 12 at its first and second surfaces 12*a,b* to effect locally plastically deformed compressive layers 26 therein. The electrical energy carried by the coils 14,16 is converted into mechanical energy by the generated electromagnetic field induced through the disk 12 which completes the electromagnetic circuit with the coils 14,16.

Since the coil faces match the profile of both sides of the disk 12, the compressive layers 26 are simultaneously formed over the entire opposite surfaces of the disk 12 from the bore of the hub 12*c* to the perimeter of the rim 12*d* in one operation.

Since the forces are preferably produced simultaneously on both sides of the disk 12 in substantially equal magnitude but in opposite directions, net force is balanced thereon and net movement of the disk 12 is prevented, and therefore the possibility of distortion of the disk 12 is also prevented.

The electromagnetic field is preferably generated in a relatively short time duration electromagnetic pulse in a time range of about 10 to 100 microseconds, for example. The amount of magnetic pressure that is required for specific applications is a function of the strength of the workpiece material itself. The magnitude of the magnetic pressure is proportional to the square of the field intensity which depends on the voltage to which the capacitor 20*b* is charged, and the volume of the effective gap between the coils and workpiece.

During electromagnetic peening, the pulse can be precisely controlled in both magnitude and duration with a suitable controller in the power supply 20, thusly providing excellent repeatability and maintenance of close tolerances in precision machined parts. Since the initial workpiece such as the disk 12 is initially precision machined, the peening thereof must be effected within suitable tolerances for providing an acceptable compressive layer 26 without undesirable distortion of the workpiece which would render the part unusable.

Since peening occurs by the electromagnetic force instead of mechanical impact as would occur with conventional shot peening, there is no surface layer damage at high intensity peening forces, and no directional surface material growth which would cause part distortion. The peening apparatus may be operated to impart residual compressive stresses in the disk surfaces which are substantially higher and to a greater depth than conventional peening for further improving the efficacy of the peened workpiece from a fracture mechanics standpoint. The microsecond peening process provides a substantial reduction in time over conventional shot peening processes which decreases the cost of manufacture.

Since considerable electrical current may be carried by the conductors 22 illustrated in FIG. 3, with a corresponding generation of heat, the individual conductors 22 may have a suitable tubular configuration with a central channel 22*a* through which may flow a suitable coolant, such as water, from a cooling supply 28 illustrated schematically in FIG. 1. The individual conductors 22 may have any suitable cross section from circular to generally rectangular as illustrated in the exemplary embodiment of FIG. 3. The cooling supply 28 may include a suitable coolant reservoir, pump, and conduits disposed in flow communication with the separate conductors 22 of the first and second coils 14,16 for channeling the coolant therethrough. A suitable heat exchanger is also provided for removing the heat from the coolant once extracted from the coils 14,16.

Figure 2:
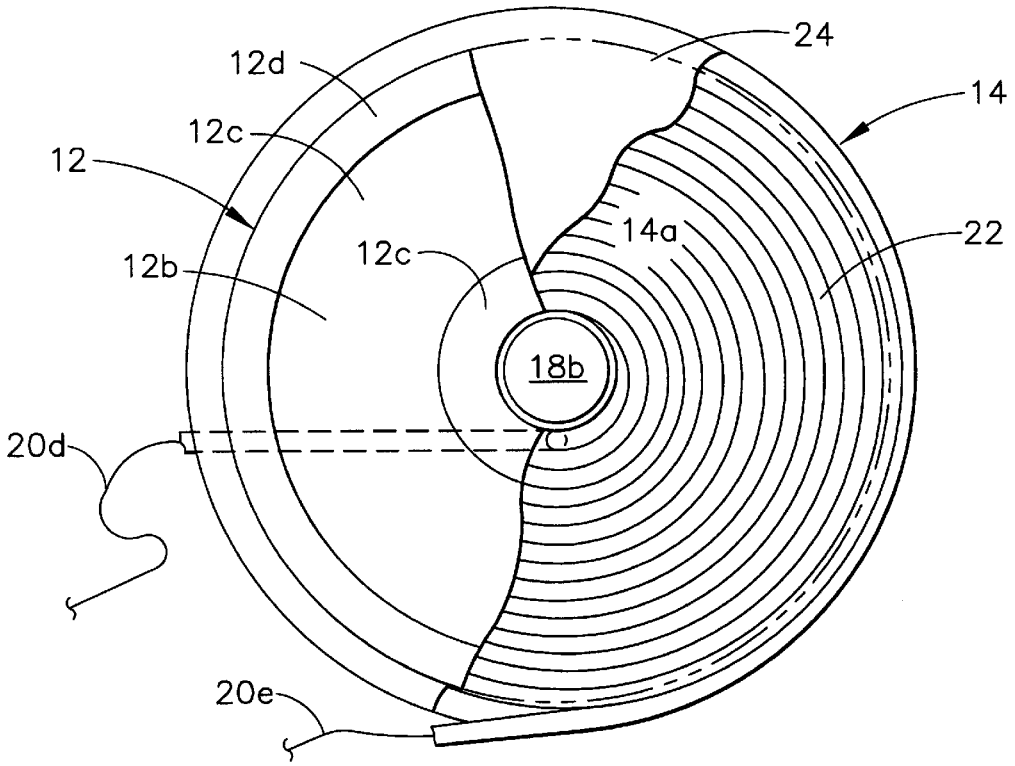
FIG. 2 is an elevational view of the rotor disk and a portion of the peening apparatus illustrated in FIG. 1 and taken along line 2—2.
Figure 4:
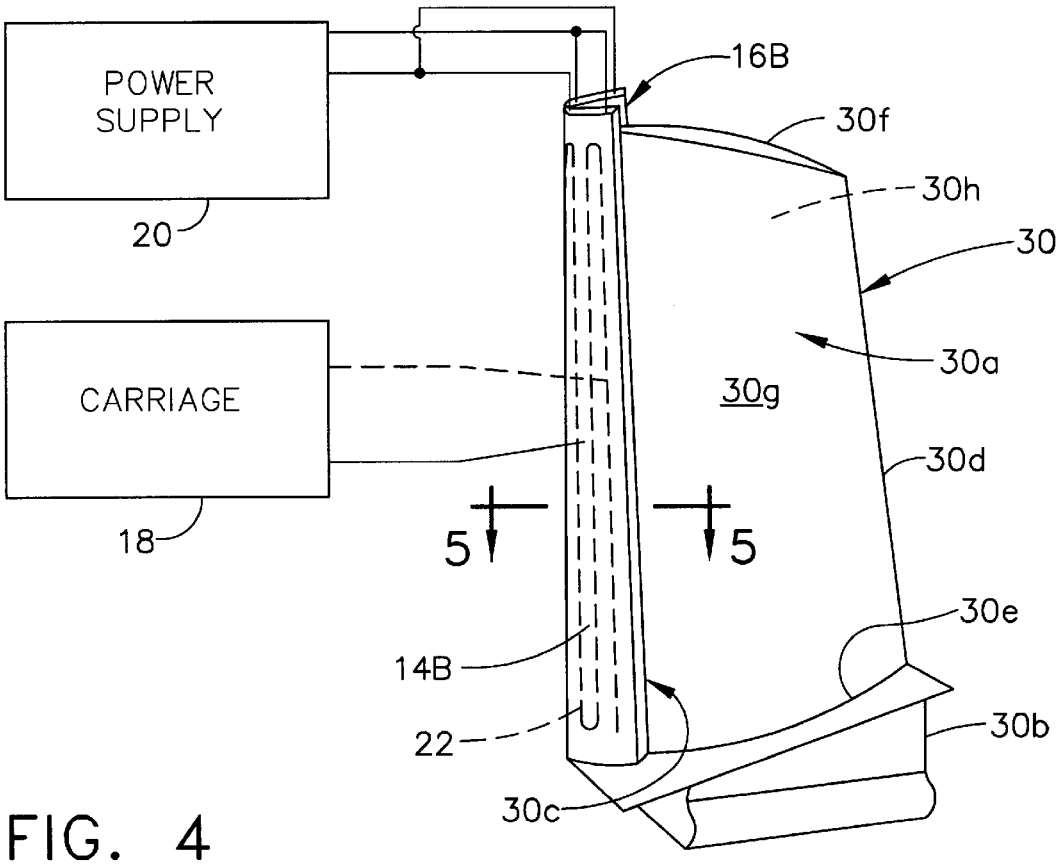
FIG. 4 is a schematic representation of the electromagnetic peening apparatus in accordance with a second embodiment of the present invention having first and second coils configured for peening the leading edge of a gas turbine engine rotor blade.

As indicated above, the coils 14,16 may be suitably configured for matching the specific profile of the individual workpieces, such as the disk 12 illustrated in FIGS. 1–3. In an alternate embodiment illustrated in FIGS. 4 and 5, the workpiece is in the form of a gas turbine engine rotor blade 30. The blade 30 includes an airfoil 30*a* over which air or combustion gases may flow depending on the design application of the blade. The blade includes an integral dovetail 30*b* configured for mounting the blade 30 in a corresponding dovetail slot in the rim of a rotor disk. The airfoil 30*a* includes a leading edge 30*c,* and a trailing edge 30*d* extending radially or spanwise from a root 30*e* to a tip 30*f* of the blade. And, the airfoil 30*a* has a generally convex suction side 30*g* and a generally concave pressure side 30*h.*

Figure 5:
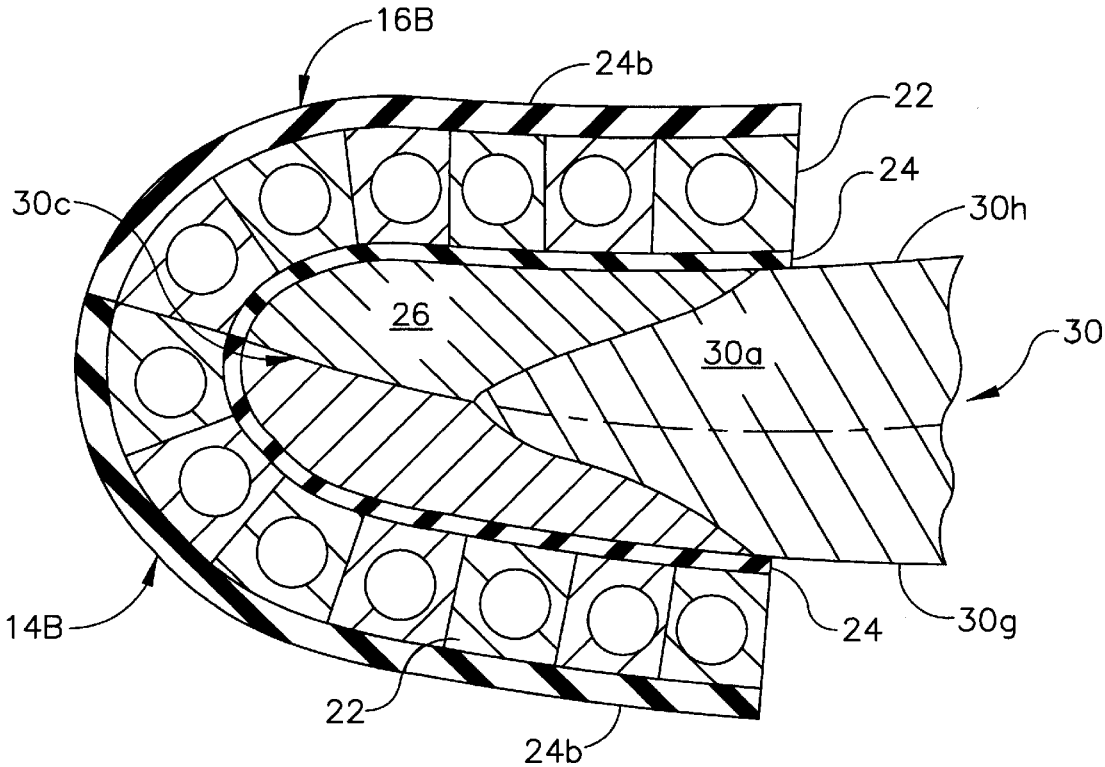
FIG. 5 is a radial sectional view through the leading edge of the blade airfoil illustrated in FIG. 4 with abutting first and second coils for effecting peening thereof.

In this embodiment of the peening apparatus, the coils are designated 14B and 16B and are configured to abut the airfoil 30*a* around the leading edge 30*c* thereof from both sides 30*g,h* as illustrated in FIG. 5. The conductors 22 as illustrated in dashed line in FIG. 4 preferably serpentine spanwise along respective portions of the airfoil 30*a* at the leading edge 30*c,* or alternatively at the trailing edge 30*d,* in two adjoining coil halves.

This embodiment of the first and second coils 14B,16B is generally similar in construction to the first coils 14,16 illustrated in FIG. 3 with analogous electrical conductors 22, face sheets 24 and backers 24*b.*

During operation, the electromagnetic force generated by each of the coil halves 14B, 16B effects a respective residual compressive layer 26 in the airfoil leading edge 30*c.* Since the airfoil leading edge is relatively thin, the compressive layer 26 on both sides of the airfoil merge inside the leading edge 30*c* for forming a continuous compressive layer therearound.

The coils of the peening apparatus 10 may be suitably configured in matching pairs to conform with the opposite sides of the specific workpiece such as the rotor disk 12 or the rotor blade 30. The coils are preferably configured to provide substantially equal and opposite magnetic force, preferably simultaneously, for simultaneously generating the compressive layers 26 on opposite sides of the workpiece with a substantially zero net force being applied to the workpiece to prevent its movement or distortion during the peening operation. The collective forces in the coils may be substantially large, with the coils being configured to balance these forces and prevent undesirable distortion of the initial workpiece already machined within suitably small tolerances. The peening operating is one of the last manufacturing processes, and it is important to prevent damage to the workpiece at this stage.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. An apparatus for electromagnetic peening a compressive layer in a machined component comprising:

a first electromagnetic coil having a first face configured to conform to a first surface of said component;

a second electromagnetic coil having a second face configured to conform to a second surface of said component;

a carriage for positioning said first and second coils in abutting contact with said component at said respective first and second faces and surfaces; and a power supply for powering said first and second coils to produce electromagnetic force therein to plastically deform said component at said first and second surfaces and effect said compressive layer therein.

2. An apparatus according to claim 1 wherein said carriage is configured to position said first and second coils on opposite sides of said component to capture said component therebetween.

3. An apparatus according to claim 2 wherein said power supply is operatively joined to both said first and second coils to produce said electromagnetic force substantially simultaneously.

4. An apparatus according to claim 3 wherein:

said first and second coils are complementary to said first and second surfaces, respectively; and said power supply is configured to produce substantially equal and opposite electromagnetic forces from both said first and second coils.

5. An apparatus according to claim 4 wherein each of said first and second coils comprises an electrical conductor wound in a plurality of laterally adjacent sections collectively defining said respective first and second faces.

6. An apparatus according to claim 5 wherein each of said first and second coils further comprises an electrically insulating face sheet disposed atop said first and second faces for abutting said respective first and second surfaces to maintain a predetermined spacing therefrom.

7. An apparatus according to claim 6 wherein:

said component is a gas turbine engine rotor disk having a radially inner hub, a radially outer rim, a thinner web extending therebetween, and opposite axial sides defining said first and second surfaces extending radially from said hub to said rim; and said conductors of said first and second coils spiral to form disk coils being complementary to said rotor disk first and second surfaces.

8. An apparatus according to claim 6 wherein:

said component is a gas turbine engine rotor blade having an airfoil with leading and trailing edges extending spanwise between a root and tip; and said conductors of said first and second coils are configured to serpentine spanwise along respective portions of said airfoil at said leading or trailing edges in two adjoining coil halves.

9. A method for electromagnetically peening a compressive layer in a machined component comprising:

producing a first electromagnetic force on one surface of said component;

producing a second electromagnetic force on an opposite surface of said component, substantially simultaneously with said first force to plastically deform said component at said first and second surfaces and effect said compressive layer therein.

10. A method according to claim 9 further comprising applying said first and second forces on said component to substantially balance net force thereon.

* * * * *